US007908978B1

(12) United States Patent
Pelton, Jr.

(10) Patent No.: US 7,908,978 B1
(45) Date of Patent: Mar. 22, 2011

(54) COMPUTER GAMING STATION

(76) Inventor: Howard D. Pelton, Jr., Clear Lake, IA (US)

( * ) Notice: Subject to any disclaimer, the term of this patent is extended or adjusted under 35 U.S.C. 154(b) by 369 days.

(21) Appl. No.: 12/150,588

(22) Filed: Apr. 29, 2008

(51) Int. Cl.
*A47B 37/00* (2006.01)

(52) U.S. Cl. ..... 108/50.02; 108/50.01; 108/50.14

(58) Field of Classification Search ..... 312/223.1, 312/235.1; 108/3–4, 6–10, 50.01, 50.02, 108/50.14, 92–93, 101, 193
See application file for complete search history.

(56) References Cited

U.S. PATENT DOCUMENTS

| | | | | | |
|---|---|---|---|---|---|
| 1,933,210 | A | * | 10/1933 | Curtis | 108/50.14 |
| 1,975,004 | A | * | 9/1934 | Jenkins | 312/195 |
| 2,522,748 | A | * | 9/1950 | Claude | 108/101 |
| 4,540,222 | A | * | 9/1985 | Burrell | 312/257.1 |
| 5,044,284 | A | * | 9/1991 | Gross | 108/10 |
| D341,958 | S | * | 12/1993 | Allred | D6/406 |
| 5,546,873 | A | * | 8/1996 | Conner et al. | 108/90 |
| 5,577,806 | A | * | 11/1996 | Ugalde | 297/423.46 |
| 5,769,514 | A | | 6/1998 | Brown et al. | |
| 5,851,166 | A | * | 12/1998 | Bernardson | 482/79 |
| 5,997,113 | A | * | 12/1999 | Benson | 312/195 |
| 6,012,788 | A | | 1/2000 | Marschand et al. | |
| 6,041,723 | A | | 3/2000 | Peterson | |
| 6,082,838 | A | | 7/2000 | Bissu-Palombo | |
| 6,220,181 | B1 | * | 4/2001 | Horski | 108/50.01 |
| 6,298,794 | B1 | * | 10/2001 | Brown et al. | 108/50.01 |
| 6,425,567 | B2 | * | 7/2002 | Schutze | 248/452 |
| 6,604,783 | B2 | | 8/2003 | Goodson | |
| 6,694,896 | B1 | | 2/2004 | Milazzo | |
| 6,736,469 | B2 | * | 5/2004 | Long | 312/223.3 |
| 6,874,431 | B1 | * | 4/2005 | Danna | 108/143 |
| 6,948,786 | B1 | | 9/2005 | Chung | |
| 7,004,081 | B2 | * | 2/2006 | Chang | 108/50.01 |
| 7,156,026 | B2 | * | 1/2007 | McClellion | 108/43 |
| 7,322,656 | B2 | * | 1/2008 | Wang | 297/423.41 |
| 7,339,782 | B1 | * | 3/2008 | Landes et al. | 361/679.27 |
| 7,430,114 | B2 | * | 9/2008 | Rouleau et al. | 361/679.55 |
| 2002/0020329 | A1 | * | 2/2002 | Kowalski | 108/50.01 |
| 2004/0065235 | A1 | * | 4/2004 | de Oliveira | 108/50.01 |
| 2005/0092215 | A1 | * | 5/2005 | Nien | 108/65 |
| 2005/0094361 | A1 | * | 5/2005 | Lee | 361/681 |

FOREIGN PATENT DOCUMENTS

| | | | | |
|---|---|---|---|---|
| EP | 172762 | * | 2/1986 | 312/223.3 |

* cited by examiner

*Primary Examiner* — Hanh V Tran
(74) *Attorney, Agent, or Firm* — Montgomery Patent and Design; Robert C. Montgomery

(57) ABSTRACT

A user-assembled desk system includes specialized features for computer gaming. The top of the desk has an expanded side area for the placement of gaming aids such as joysticks, steering wheels and the like. The desk top cantilevers out from the center structure providing clearance for a large chair or recliner. A pair of angled, adjustable footrests are provided to facilitate foot controllers, pedals, and the like allowing the user to feel as if they are in a cockpit or a racecar. A rear panel has a power strip to electrically connect the various components. Finally, the desk sides can be decorated with various insignias, logos and characters to stylize the desk for use on a particular game or by a particular user.

16 Claims, 7 Drawing Sheets

COMPUTER GAMING STATION

RELATED APPLICATIONS

The present invention was first described in an Official Record of Invention received on Mar. 3, 2007 that is on file at the offices of Montgomery Patent and Design, LLC in Washington, Pa. There are no previously filed, nor currently any co-pending applications, anywhere in the world.

FIELD OF THE INVENTION

The present invention relates generally to a computer desk gaming station for holding peripheral gaming accessories, station comprising a table top provided with left and right extensions, a pair of side panels coupled directly to said table top and extending downwardly, a first and a second foot rest each coupled to said side panels and means for selectively and independently adjusting said first and second foot rests.

BACKGROUND OF THE INVENTION

The U.S. games market is diversifying. The age group among male players is expanding significantly into the twenty five (25) to forty (40) age group. For casual online puzzle-style and simple mobile cell phone games, the gender divide is more or less equal between males and females. Females are being significantly attracted to playing certain online multi-user video games that offer a more communal experience, and a small hardcore group of young females are playing aggressive games that are usually thought of as being "traditionally male" games. The most loyal fan-base is reported to be for large role-playing games.

Obviously, computer-based home video game systems are more popular than ever. Modern technological advancements in gaming systems have resulted in literally hundreds of games with unprecedented depth and detail. To further the realism of these games, the market has responded with a wealth of input devices such as joysticks, steering wheels, foot-operated pedals and the like. However, one is faced with many compromises when these accessories are used at conventional desks. First, the desktop is not big enough to accommodate such devices. Second, one cannot fit a large, comfortable chair close enough to the desk. Third, there is no provision for a footrest to hold the pedal systems. Finally, the high-tech look of the gaming system is dampened by the business-like look of a conventional desk. While some gaming desks are available, they are typically cost prohibitive.

Accordingly, there exists a need for a means by which computer gaming system users can be provided with a desk system that addresses the above concerns. The development of the present invention fulfills this need.

U.S. Pat. No. 6,948,786 filed by Chung discloses furniture having compound foldable parts. This patent does not appear to disclose an apparatus that is specifically adapted for computer gaming systems and that possesses the following attributes: a table top capable of being widened as necessary, foot rests that will accommodate gaming accessories and a cord routing system.

U.S. Pat. No. 6,694,896 filed by Milazzo discloses a foldable table or desk. This patent does not appear to disclose an apparatus that is specifically adapted for computer gaming systems and that possesses the following attributes: a table top capable of being widened as necessary, foot rests that will accommodate gaming accessories and a cord routing system.

U.S. Pat. No. 6,604,783 filed by Goodsen discloses a portable collapsible workstation. This patent does not appear to disclose an apparatus tailored for computer gaming that possesses adjustable footrests and an expansive table top to accommodate computer gaming accessories.

U.S. Pat. No. 6,082,838 filed by Bissu-Palombo discloses a foldable and assemblable desk. This patent does not appear to disclose an apparatus tailored for computer gaming that possesses adjustable footrests and an expansive table top to accommodate computer gaming accessories.

U.S. Pat. No. 6,041,723 filed by Peterson discloses a portable collapsible self-assembling desk. This patent does not appear to disclose an apparatus that is specifically adapted for computer gaming systems and that possesses the following attributes: a table top capable of being widened as necessary, foot rests that will accommodate gaming accessories and a cord routing system.

U.S. Pat. No. 6,012,788 filed by Marschand et al discloses a laptop computer desk. This patent does not appear to disclose an apparatus tailored for computer gaming that possesses adjustable footrests and an expansive table top to accommodate computer gaming accessories.

U.S. Pat. No. 5,997,113 filed by Benson discloses a foldable and portable furniture. This patent does not appear to disclose an apparatus that is specifically adapted for computer gaming systems and that possesses the following attributes: a table top capable of being widened as necessary, foot rests that will accommodate gaming accessories and a cord routing system.

U.S. Pat. No. 5,769,514 filed by Brown et al. discloses a ready to use foldable computer desk. This patent does not appear to disclose an apparatus that is specifically adapted for computer gaming systems and that possesses the following attributes: a table top capable of being widened as necessary, foot rests that will accommodate gaming accessories and a cord routing system.

The prior art appears to disclose furniture that is designed for computer systems. The prior art does not appear to disclose an apparatus that is specifically adapted for computer gaming system applications and that possesses the following attributes: a table top capable of being widened as necessary, foot rests that will accommodate gaming accessories and a cord routing system.

SUMMARY OF THE INVENTION

In view of the foregoing disadvantages inherent in the prior art, it has been observed that there is need for computer gaming station that provides a means for a user-assembled desk system having specialized features for computer gaming.

The computer gaming system provides on its top surface an expanded side area for the placement of purchased gaming accessories such as, but not limited to, joysticks, steering wheels, and the like.

The computer gaming system provides a wide center structure which cantilevers out toward the operator providing clearance for an upright chair or recliner.

The computer gaming system further possesses a pair of adjustable foot rests that provide a mounting surface for additional purchased accessories such as, but not limited to, foot controllers, pedals, and the like that permit the user to feel as if they are in an airplane cockpit or racecar.

The computer gaming system further provides a power strip and may be decorated with various insignias and logos. These indicia may provide script or logos based upon a user's preference and may include images such as, but not limited to, computer game names, sports names/logos, personal names, symbols, pictures, and the like to further customize and personalize the apparatus.

The computer gaming system is capable of receiving the height and width of a large chair or recliner.

The computer gaming system comprises a table top, a pair of side panels, a first foot rest, and a second foot rest.

The table top provides ample top surface for mounting and positioning several purchased gaming accessories common to modern gaming systems such as, but not limited to, a monitor, a steering wheel, a joystick and speakers. The table top further comprises a left extension and a right extension each being approximately one (1) foot square and protruding laterally along a front edge facing the operator. The extensions provide additional area for gaming accessories such as, but not limited to, a mouse, a keyboard, and the like. The table top also extends toward the user beyond the side panels in a cantilever fashion approximately six (6) to twelve (12) inches, thereby allowing the operator to position the upright chair or recliner forward and beneath the table top, providing improved accessibility to the gaming equipment and accessories.

The table top also comprises a central box-shaped framing assembly along a bottom surface thereof comprising a rear panel member, a front frame member, a right frame member, and a left frame member. These frame members comprise a four (4) piece rectangular structure providing an attachment means thereto the table top and the side panels using fasteners, such as, but not limited to, screws, bolts, and threaded inserts. These frame members provide additional structural integrity to the apparatus.

The side panels comprise trapezoidal vertical supporting panels providing a leg function and a tapered width up to an attachment location at a side surface of the right and left frame members. Each side panel comprises a wire routing aperture, a pair of runners, a first adjusting slot, a second adjusting slot, a first pivot feature, a second pivot feature, and a pair of adjustment knobs. The wire routing aperture is envisioned to be a drilled through-hole located at a lower forward corner of each side panel being approximately two (2) to three (3) inches in diameter and providing an organizing means to various wires and cables associated with the aforementioned purchased gaming accessories. The runners provide a protection means to a floor surface and are made using a channel-shaped plastic extrusion attached to a bottom edge of said side panel at a front and rear location using fastening means such as adhesives, screws, or the like. The adjusting slots, pivot features, and knobs are located at upper and lower positions along outer surfaces of the side panels providing an adjustable angle means to the foot rest portions. The adjusting slots are formed in an arcuate shape having a center of rotation about the pivot features.

The first and second foot rests comprise upper and lower pivotingly adjustable rectangular foot platforms extending between the two (2) side panels. The first and second foot rests further provide a mounting surface for various purchased gaming foot controls such as simulated foot pedals and the like, which emulate a realistic racecar or flight-like experience.

The first foot rest provides an upper foot platform for comfortably supporting one's feet while seated in a recliner type chair resulting in a slightly elevated foot position. The first foot rest further comprises a pair of integral first pivot rods and a pair of first threaded holes. Said first pivot rods are located along opposing outside surfaces of the first foot rest at a lower position thereupon, providing an attachment means thereto adjacent side panels by being slidingly inserted therein the female first pivot features forming a rotating axle therein. The first pivot rods are pressed into drilled holes therein the first foot rest along opposing lower outside edges. The first pivot rods are envisioned to be made using metal dowel stock ranging from one-quarter (¼) to one-half (½) inch in diameter and protruding outwardly approximately three-quarters (¾) of an inch forming an axle-type appendage. The first threaded holes are located along opposing outside surfaces the first foot rest but at an upper position thereupon, are particularly spaced so as to correspond to the first pivot features. The first threaded holes are threaded and positioned to receive the threaded shaft portion of the knobs providing a clamping means securing an angular position thereof the first foot rest. The first threaded holes are envisioned to be made using threaded drilled holes, threaded inserts, or the like.

The second foot rest comprises a pair of second threaded holes and a pair of second pivot rods. The second foot rest is a lower foot platform for comfortably supporting one's feet while seated in an upright chair resulting in a slightly lower foot position. The second foot rest is envisioned to comprise similar function and construction as the first foot rest.

The table top, side panels, and the foot rest portions of the apparatus are made using wood products such as plywood or composite fiberboard. These components may also be made using plastic, fiberglass, or metal materials. It is further envisioned that the panels may be provided with various protective coatings such as contact paper, Formica®, or wood laminates in decorative colors and patterns. The attachment means between the various components of the apparatus may include various conventional carpentry methods and fasteners, common in the industry, such as, but not limited to, dado joints, rabbet joints, butt joints, angle brackets, screws, bolts, threaded inserts, and the like.

The computer gaming system further comprises a front frame member and a rear panel member. The rear panel member comprises a common power strip and a pair of wire routing apertures located at opposing ends. The power strip is mounted on an inside surface providing electrical power distribution in an expected manner to the various gaming components and accessories therein.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
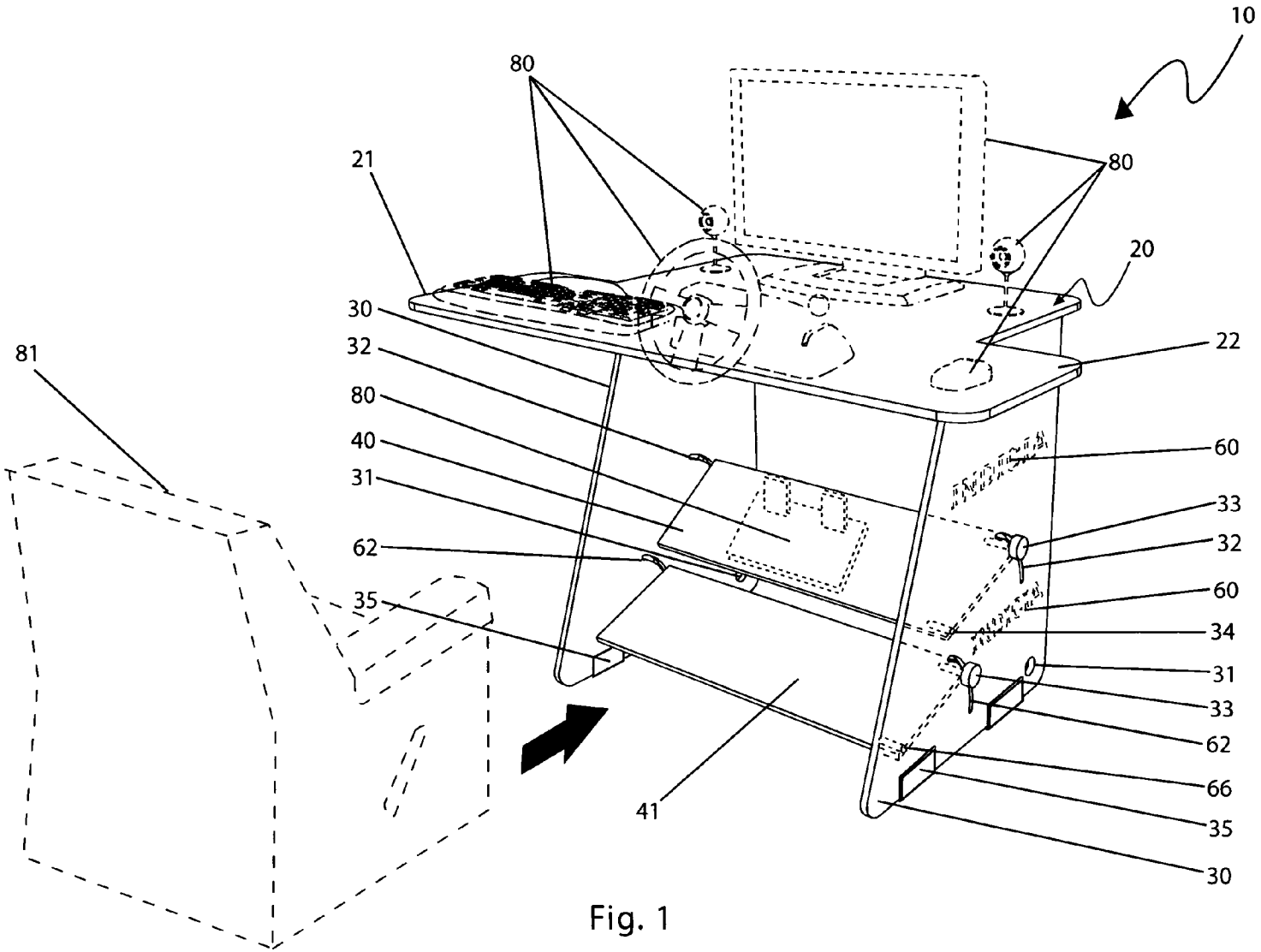
FIG. 1 is a perspective view of a computer gaming station 10, according to a preferred embodiment of the present invention embodiment of the present invention.

| DESCRIPTIVE KEY | |
|---|---|
| 10 | computer gaming station |
| 20 | table top |
| 21 | left extension |
| 22 | right extension |
| 30 | side panel |
| 31 | wire routing aperture |
| 32 | first adjusting slot |
| 33 | knob |
| 34 | first pivot feature |
| 35 | runner |
| 36 | first pivot rod |
| 37 | first threaded hole |
| 38 | second threaded hole |
| 40 | first foot rest |
| 41 | second foot rest |
| 50 | rear panel member |
| 51 | front frame member |
| 52 | right frame member |
| 53 | left frame member |
| 54 | power strip |
| 55 | main electrical power cord |
| 60 | indicia |
| 62 | second adjusting slot |
| 64 | second pivot feature |
| 66 | second pivot rod |
| 70 | fasteners |
| 80 | purchased computer accessory |
| 81 | recliner |

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a computer gaming station (herein described as the "apparatus") 10, which provides a means for a user-assembled desk system having specialized features for computer gaming. The top surface 20 of the apparatus 10 has an expanded side area for the placement of purchased gaming accessories 80 such as joysticks, steering wheels, and the like. The apparatus 10 provides a wide center structure which cantilevers out toward the operator providing clearance for an upright chair or recliner 81. A pair of adjustable foot rests 40, 41 provide a mounting surface for additional purchased accessories 80 such as foot controllers, pedals, and the like allowing the user to feel as if they are in an airplane cockpit or racecar. The apparatus 10 further comprises a power strip 54 and may be decorated with various insignias and logos 60.

Referring now to FIG. 1, a perspective view of the apparatus 10, according to the preferred embodiment of the present invention, is disclosed. The apparatus 10 comprises a table top 20, a pair of side panels 30, a first foot rest 40, and a second foot rest 41. The apparatus 10 provides a comfortable gaming apparatus 10 capable of receiving a height and width of a large chair or recliner 81. The apparatus 10 is shown here working in conjunction with a recliner type chair 81 utilizing a slightly elevated first foot rest 40, thereby emulating a racecar or flight position to a user.

The table top 20 provides ample top surface for mounting and positioning several purchased gaming accessories 80 common to modern gaming systems such as, but not limited to, a monitor, a steering wheel, a joy stick, speakers, and the like. The table top 20 further comprises a left extension 21 and a right extension 22 each being approximately one (1) foot square and protruding laterally along a front edge facing the operator. The extensions 21, 22 provide additional area for gaming accessories such as, but, not limited to, a mouse, a keyboard, and the like. The table top 20 also extends toward the user beyond the side panels 30 in a cantilever fashion approximately six (6) to twelve (12) inches, thereby allowing the operator to position the upright chair or recliner 81 forward and beneath the table top 20, thereby providing improved accessibility to the gaming equipment and accessories 80.

Figure 2:
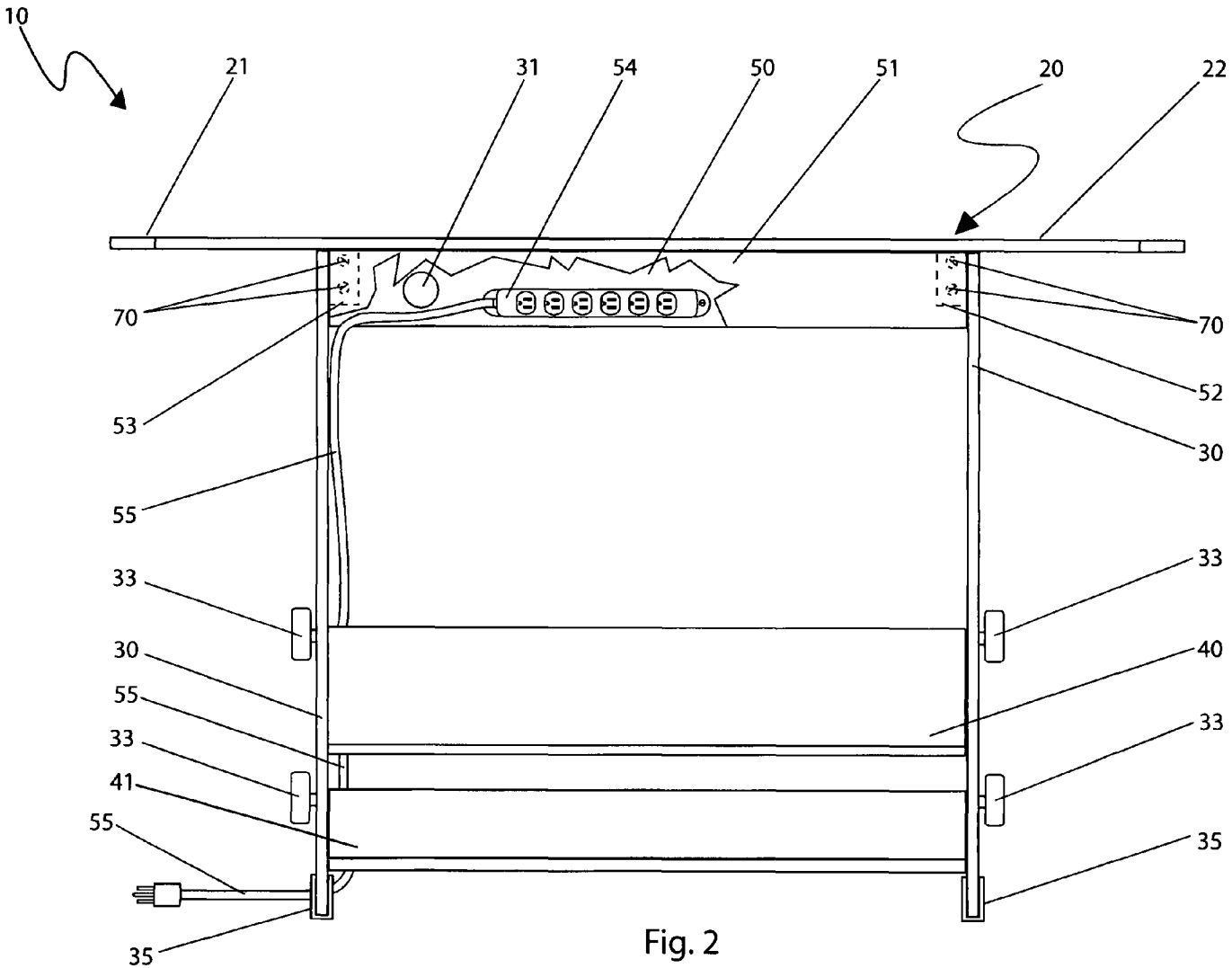
FIG. 2 is a front view of a computer gaming station 10, according to a preferred embodiment of the present invention.
Figure 3:
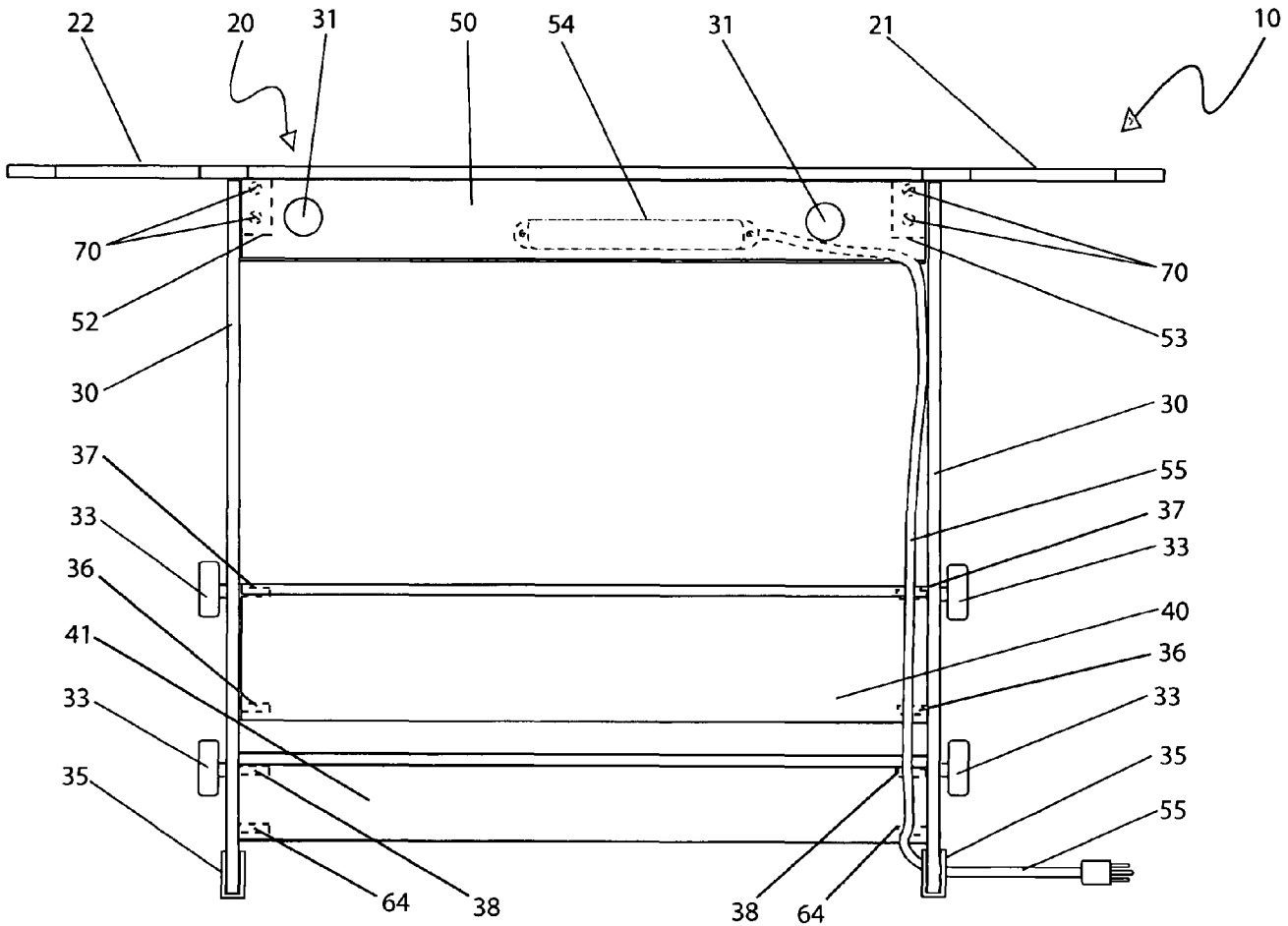
FIG. 3 is a rear view of a computer gaming station 10, according to a preferred embodiment of the present invention.
Figure 4:
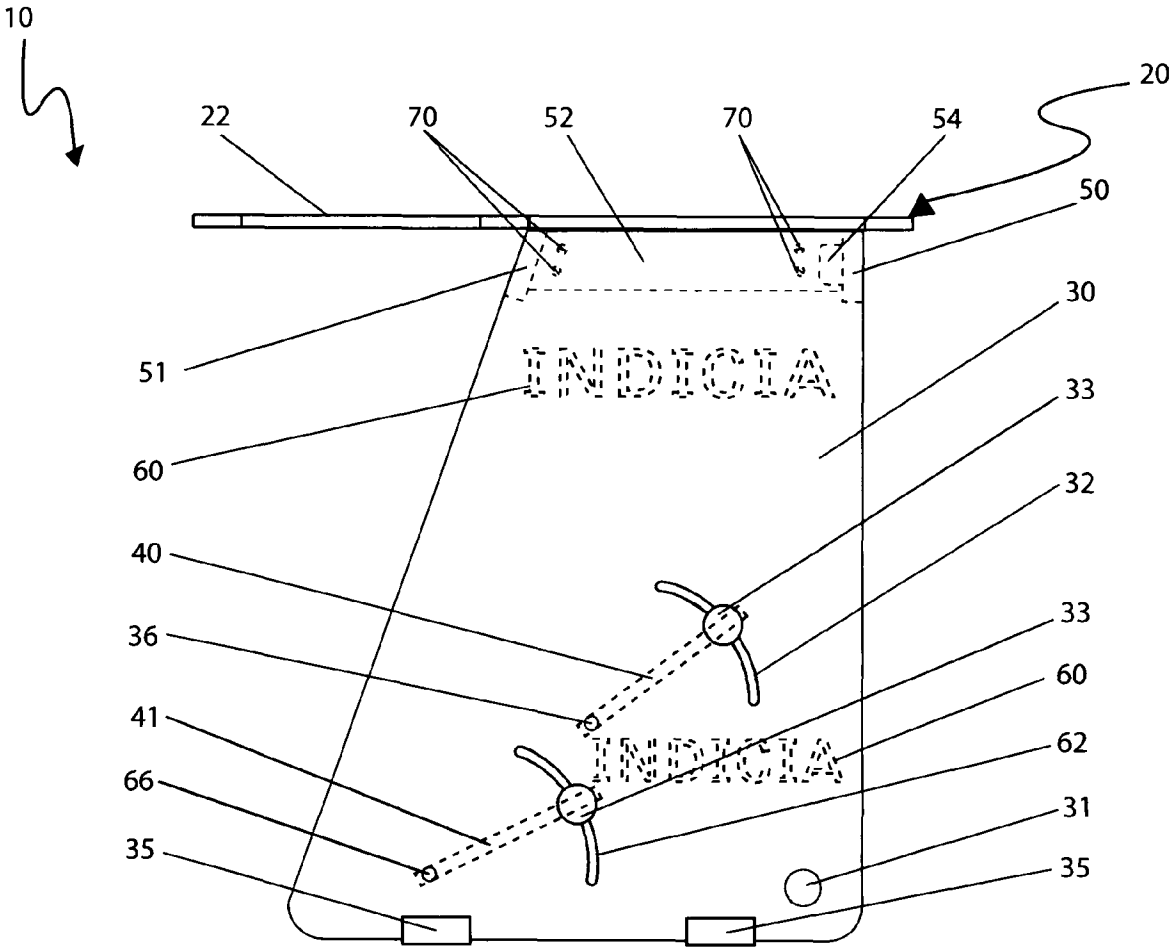
FIG. 4 is a right-hand view of a computer gaming station 10, according to a preferred embodiment of the present invention.
Figure 5:
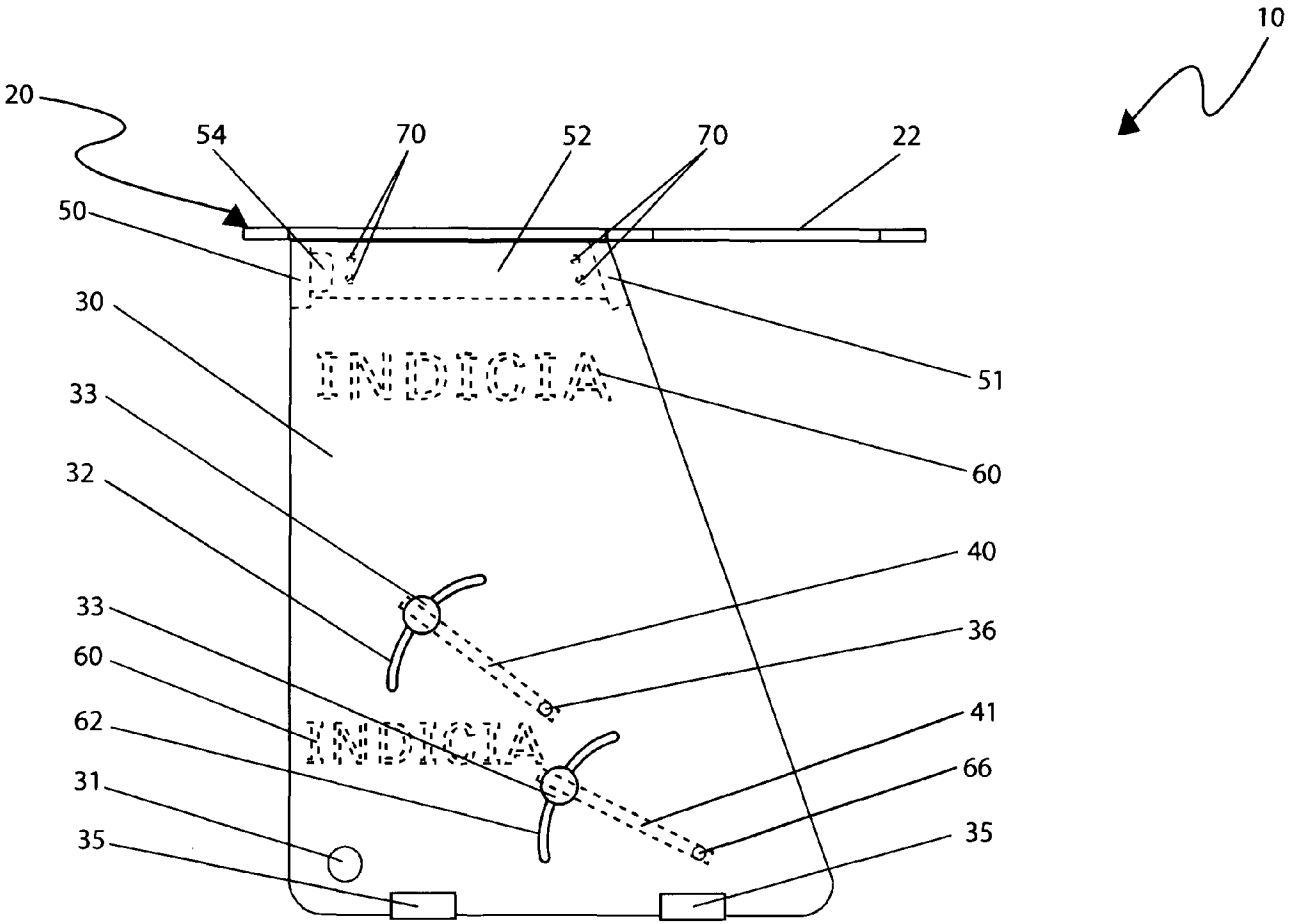
FIG. 5 is a left-hand view of a computer gaming station 10, according to a preferred embodiment of the present invention.
Figure 6:
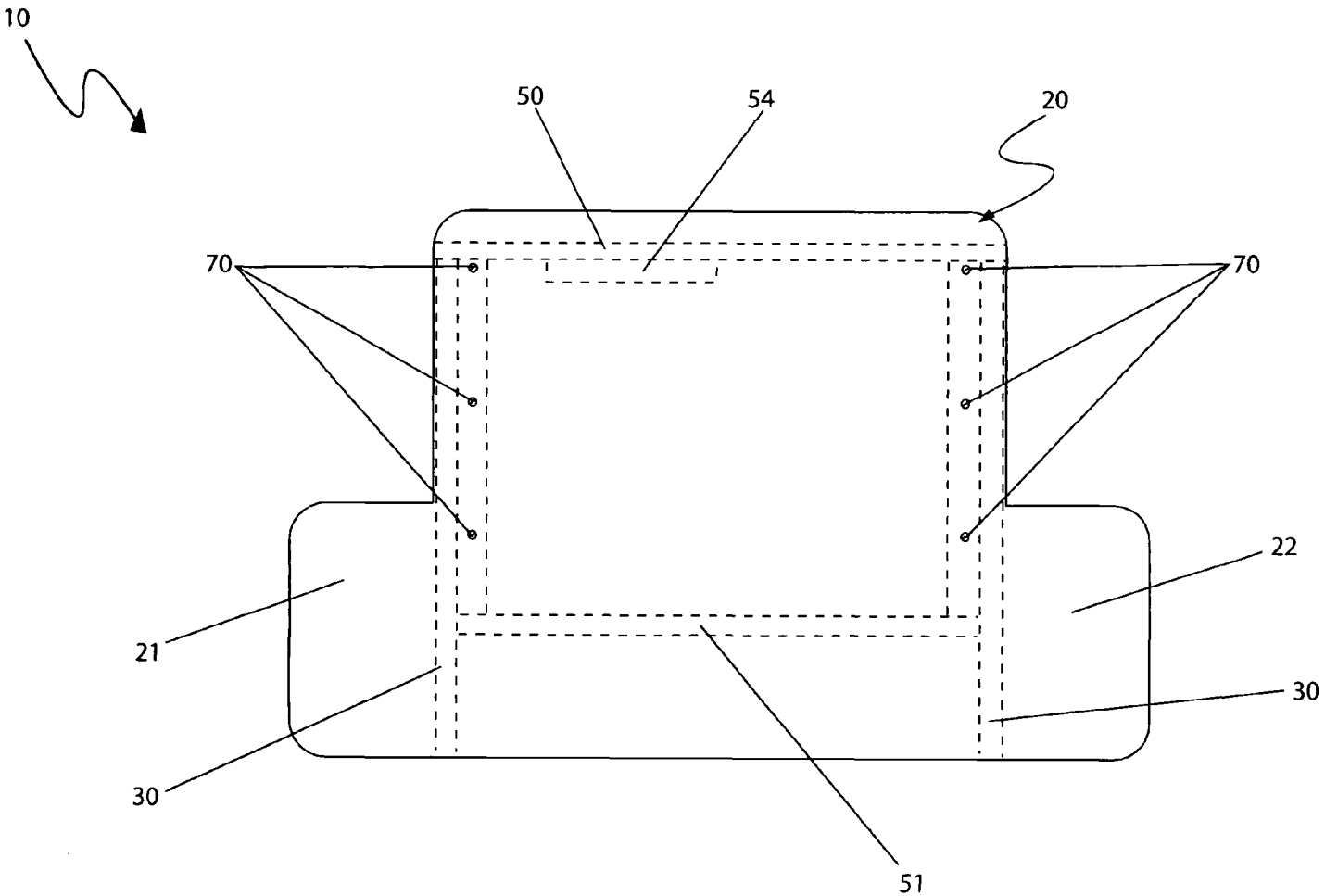
FIG. 6 is a top view of a computer gaming station 10, according to a preferred embodiment of the present invention; and, FIG. 7 is a bottom view of a computer gaming station 10, according to a preferred embodiment of the present invention.
Figure 7:
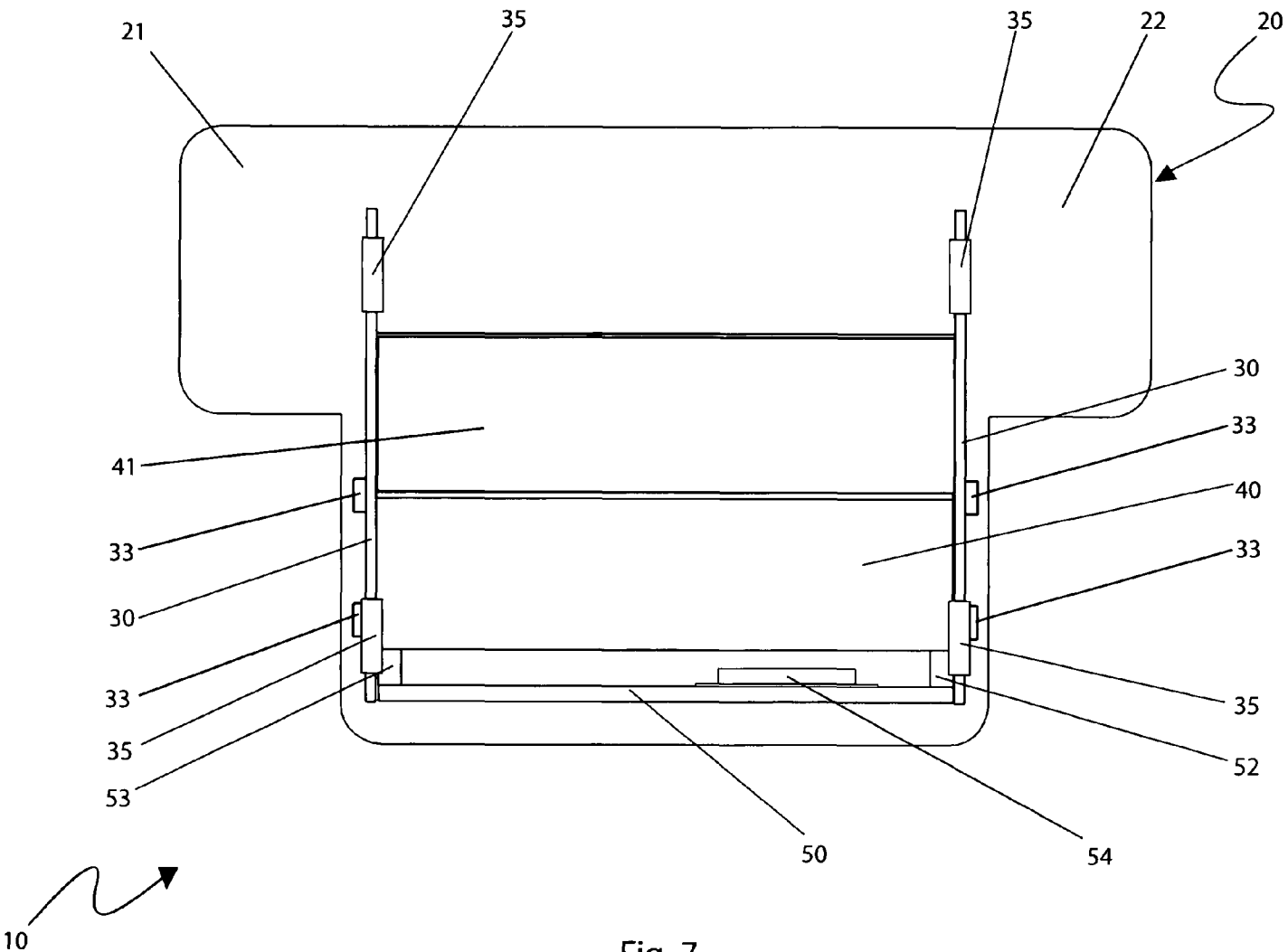

The table top 20 also comprises a central box-shaped framing assembly along a bottom surface thereof comprising a rear panel member 50, a front frame member 51, a right frame member 52, and a left frame member 53 (see FIGS. 2 and 3). Said members 50, 51, 52, 53 comprise a four (4) piece rectangular structure providing an attachment means thereto the table top 20 and the side panels 30 using fasteners 70 such as screws, bolts, threaded inserts, and the like. Said members 50, 51, 52, 53 provide additional structural integrity to the apparatus 10.

The side panels 30 comprise trapezoidal vertical supporting panels providing a leg function and a tapered width up to an attachment location at a side surface of the right 52 and left 53 frame members. Each side panel 30 further comprises a wire routing aperture 31, a pair of runners 35, a first adjusting slot 32, a second adjusting slot 62, a first pivot feature 34, a second pivot feature 64, and a pair of adjustment knobs 33. The wire routing aperture 31 is envisioned to be a drilled through-hole located at a lower forward corner of each side panel 30 being approximately two (2) to three (3) inches in diameter and providing an organizing means to various wires and cables associated with the aforementioned purchased gaming accessories 80. The runners 35 provide a protection means to a floor surface and are envisioned to be made using a channel-shaped plastic extrusion attached thereto a bottom edge of said side panel 30 at a front and rear location using fastening means 70 such as adhesives, screws, or the like. The adjusting slots 32, 62, pivot features 34, 64, and knobs 33 are located at upper and lower positions along outer surfaces of the side panels 30 providing an adjustable angle means to the foot rest portions 40, 41. The adjusting slots 32, 62 are formed in an arcuate shape having a center of rotation about the pivot features 34, 64.

The first 40 and second 41 foot rests comprise upper and lower pivotingly adjustable rectangular foot platforms extending therebetween the two (2) side panels 30. The first 40 and second 41 foot rests further provides a mounting surface for various purchased gaming foot controls 80 such as simulated foot pedals and the like, thereby emulating a realistic racecar or flight-like experience.

The first foot rest 40 provides an upper foot platform for comfortably supporting one's feet while seated in a recliner type chair resulting in a slightly elevated foot position. The first foot rest 40 further comprises a pair of integral first pivot rods 36 and a pair of first threaded holes 37. Said first pivot rods 36 are located along opposing outside surfaces of the first foot rest 40 at a lower position thereupon, providing an attachment means thereto adjacent side panels 30 by being slidingly inserted therein the female first pivot features 34 forming a rotating axle therein. The first pivot rods 36 are envisioned to be pressed into drilled holes therein the first foot rest 40 along opposing lower outside edges. The first pivot rods 36 are envisioned to be made using metal dowel stock ranging from one-quarter (¼) to one-half (½) inch in diameter and protruding outwardly approximately three-quarters (¼) of an inch forming an axle-type appendage. The first threaded holes 37 are also located along opposing outside surfaces the first foot rest 40 but at an upper position thereupon, are particularly spaced so as to correspond to the aforementioned first pivot features 34. The first threaded holes 37 are threaded and positioned to receive the threaded shaft portion of the knobs 33 providing a clamping means securing an angular position thereof the first foot rest 40. The first threaded holes 37 are envisioned to be made using threaded drilled holes, threaded inserts, or the like.

The second foot rest 41 comprises a pair of second threaded holes 38 and a pair of second pivot rods 66. Said second foot rest 41 a lower foot platform for comfortably supporting one's feet while seated in an upright chair resulting in a slightly lower foot position. The second foot rest 41 is envisioned to comprise similar function and construction as the aforementioned first foot rest 40.

It is envisioned that the table top 20, side panels 30, and the foot rest portions 40, 41 of the apparatus 10 are made preferably using wood products such as plywood or composite fiberboard; however, it is envisioned that said panels 20, 30, 40, 41 may also be made using plastic, fiberglass, or metal materials without deviating from the basic concept and as such should not be interpreted as a limiting factor of the present invention 10. It is further envisioned that said panels 20, 30, 40, 41 may be provided with various protective coatings such as contact paper, Formica®, or wood laminates in decorative colors and patterns, and as such should not be considered a limiting factor of the invention 10.

The attachment means between the various components of the apparatus 10 may include various conventional carpentry methods and fasteners 70 such as dado joints, rabbet joints, butt joints, angle brackets, screws, bolts, threaded inserts, and the like, being common in the industry.

Referring now to FIG. 2, a front view of the apparatus 10, according to the preferred embodiment of the present invention, is disclosed. The apparatus 10 comprises a front frame member 51 and a rear panel member 50. The rear panel member 50 further comprises a common power strip 54 and a pair of wire routing apertures 31 located at opposing ends thereof. The power strip 54 is mounted thereon an inside surface providing electrical power distribution in an expected manner to the various gaming components and accessories 80 therein.

Referring now to FIG. 3, 4, 5, 6, 7, rear, right-hand, left-hand, top, and bottom views of the apparatus 10, respectively, according to the preferred embodiment of the present invention, are disclosed. Depicted on FIGS. 4 and 5, right-hand and left-hand views, respectively, are various indicia 60 which may provide script or logos based upon a user's preference and may include images such as, but not limited to, computer game names, sports names/logos, personal names, symbols, pictures, and the like to further customize and personalize the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: attaching the right 52 and left 53 frame members to a bottom surface of the table top portion 20 using provided fasteners 70; attaching the rear panel member 50 and front panel member 51 to the right 52 and left 53 frame members using the provided fasteners 70; attaching a side panel 30 to the right frame member 52 using the provided fasteners 70; positioning the foot rests 40, 41 and remaining side panel 30 coincidentally to the left frame member 53 by inserting the pivot rods 36, 66 into the pivot features 34, 64; attaching the side panels 30 to the right 52 and left 53 frame members using the provided fasteners 70; inserting the four (4) knobs 33 through the adjusting slots 32, 62 and threading thereinto the threaded holes 37, 38; placing the apparatus 10 in an upright orientation upon a floor surface in a desired location; turning the knobs 33 in a counter-clockwise direction to loosen the foot rests 40, 41; adjusting the foot rests 40, 41 to a desired angle; tightening the knobs 33 by turning in a clockwise direction to secure a position of the foot rests 40, 41; mounting all purchased gaming equipment and accessories 80 to the apparatus 10; connecting all equipment and accessory 80 power cords into the power strip 54; routing and connecting all necessary wiring and cables between said equipment and accessories 80 using the wire routing apertures 31; plugging the main electrical power cord 55 into a wall outlet; providing the gaming equipment and accessories 80 with electrical power in an expected manner by energizing the power strip 54; activating individual gaming equipment components 80; positioning one's upright chair or recliner 81 at a comfortable distance to the apparatus 10; participating in playing computer games as desired until a gaming session is complete; deactivating all gaming equipment and accessories 80 in an expected manner; and, enjoying the comfort and increased realism of playing computer games using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A computer desk gaming station for holding peripheral gaming accessories, said computer gaming desk station comprising:

a table top provided with left and right extensions protruding laterally along a front edge of said table top and facing an operator respectively, said left and right extensions being coplanar with said table top;

a pair of side panels coupled directly to a bottom surface of said table top and extending downwardly to a ground surface;

first and second foot rests having laterally opposed ends coupled to said side panels and intermediately disposed therebetween; and, means for selectively and independently adjusting a corresponding position of said first and second foot rests along mutually exclusive arcuate paths respectively;

wherein said first and second side panels are fixedly and statically connected to said bottom surface of said table top such that said first and second side panels are prohibited from being folded inwardly in an overlapping manner, wherein said first and second foot rest adjusting means comprises: a plurality of curvilinear adjusting slots formed in each of said side panels respectively, a plurality of pivot rods attached to inner faces of each of said side panels respectively and extending inwardly therefrom, and a plurality of adjustment knobs selectively interfitted and glided along corresponding ones of said adjusting slots while be engaged with said first and second foot rests respectively; wherein each of said first and second foot rests is pivotal about corresponding ones of said pivot rods by slidably positioning said adjustment knobs along said adjusting slots respectively; wherein each of said first and second foot rests is provided with a plurality of apertures formed at opposing ends thereof respectively such that said apertures are registered at opposing corners of each of said first and second foot rests respectively.

2. The computer gaming desk station of claim 1, wherein said table top front edge is forwardly disposed from top ends of said side panels for allowing the operator to position an existing seat beneath said table top.

3. The computer desk gaming station of claim 1, wherein said table top comprises: a box-shaped frame directly connected to said bottom surface of said table top, said box-shaped frame including:

a rear frame member;

a front frame member spaced from said rear frame member;

a right frame member connected directly to said front and rear frame members respectively; and, a left frame member connected directly to said front and rear frame members respectively.

4. The computer desk gaming station of claim 1, wherein each of said side panels is provided with a pair of runners directly conjoined to a bottom edge thereof respectively.

5. The computer desk gaming station of claim 1, wherein each of said first and second foot rests have longitudinal bottom edges extending along mutually exclusive horizontal axes and thereby engage corresponding ones of said pivot rods respectively.

6. The computer desk gaming station of claim 5, wherein each of said pivot rods are aligned parallel to each other and oriented along associated ones of the horizontal axes respectively.

7. The computer desk gaming station of claim 1, wherein said second foot rest is juxtaposed subjacent to said first foot rest and positioned forwardly thereof towards respective bottom ends of said side panels.

8. A computer desk gaming station for holding peripheral gaming accessories, said computer gaming desk station comprising:

a table top provided with left and right extensions protruding laterally along a front edge of said table top and facing an operator respectively, said left and right extensions being coplanar with said table top;

a pair of side panels coupled directly to a bottom surface of said table top and extending downwardly to a ground surface;

first and second foot rests having laterally opposed ends coupled to said side panels and intermediately disposed therebetween;

an electrical power strip mounted adjacent to said table top and extending outwardly through one of said side panels; and, means for selectively and independently adjusting a corresponding position of said first and second foot rests along mutually exclusive arcuate paths respectively;

wherein said first and second side panels are fixedly and statically connected to said bottom surface of said table top such that said first and second side panels are prohibited from being folded inwardly in an overlapping manner, wherein said first and second foot rest adjusting means comprises: a plurality of curvilinear adjusting slots formed in each of said side panels respectively, a plurality of pivot rods attached to inner faces of each of said side panels respectively and extending inwardly therefrom, and a plurality of adjustment knobs selectively interfitted and glided along corresponding ones of said adjusting slots while be engaged with said first and second foot rests respectively; wherein each of said first and second foot rests is pivotal about corresponding ones of said pivot rods by slidably positioning said adjustment knobs along said adjusting slots respectively; wherein each of said first and second foot rests is provided with a plurality of apertures formed at opposing ends thereof respectively such that said apertures are registered at opposing corners of each of said first and second foot rests respectively.

9. The computer gaming desk station of claim 8, wherein said table top front edge is forwardly disposed from top ends of said side panels for allowing the operator to position an existing seat beneath said table top.

10. The computer desk gaming station of claim 8, wherein said table top comprises: a box-shaped frame directly connected to said bottom surface of said table top, said box-shaped frame including:

a rear frame member;

a front frame member spaced from said rear frame member;

a right frame member connected directly to said front and rear frame members respectively; and, a left frame member connected directly to said front and rear frame members respectively.

11. The computer desk gaming station of claim 8, wherein each of said side panels is provided with a pair of runners directly conjoined to a bottom edge thereof respectively.

12. The computer desk gaming station of claim 8, wherein each of said first and second foot rests have longitudinal bottom edges extending along mutually exclusive horizontal axes and thereby engage corresponding ones of said pivot rods respectively.

13. The computer desk gaming station of claim 12, wherein each of said pivot rods are aligned parallel to each other and oriented along associated ones of the horizontal axes respectively.

14. The computer desk gaming station of claim 8, wherein said second foot rest is juxtaposed subjacent to said first foot rest and positioned forwardly thereof towards respective bottom ends of said side panels.

15. A method for providing a computer desk gaming station for supporting peripheral electronic devices thereon, said method comprising the steps of:

providing a table top having a bottom surface;

providing left and right frame members;

attaching said left and right frame members to said bottom surface of said table top;

providing front and rear frame members;

attaching said front and rear frame members to said left and right frame members;

providing first and second side panels as well as first and second foot rests respectively;

attaching said first and second side panels to said right and left frame members, respectively;

providing and inserting a plurality of pivot rods into said first and second side panels and said first and second foot rests respectively;

attaching first and second foot rests each having laterally opposed ends coupled to said first and second side panels;

providing each of said first and second foot rests with a plurality of apertures formed at opposing ends thereof respectively such that said apertures are registered at opposing corners of each of said first and second foot rests respectively;

providing and inserting a plurality of knobs through adjusting slots formed within said side panels; and, engaging said knobs with said first and second foot rests respectively to selectively and independently adjusting a corresponding position of said first and second foot rests along mutually exclusive arcuate paths respectively.

16. The method of claim 15, further comprising the steps of:

placing said table top and said first and second side panels at an upright orientation on a floor surface;

turning said knobs in a counter-clockwise direction to loosen said first and second foot rests respectively;

adjusting said first and second foot rests to a desired angle with respect to the floor surface;

tightening said knobs by turning said knobs in a clockwise direction;

mounting existing gaming equipment and accessories to said gaming station;

providing a power strip;

connecting the existing gaming equipment and accessories to said power strip;

routing cables of the existing gaming equipment and accessories through an aperture formed in one of said first and second side panels; and, plugging said power strip to a wall outlet.

* * * * *